US011578522B2

(12) United States Patent
Hellwig et al.

(10) Patent No.: US 11,578,522 B2
(45) Date of Patent: Feb. 14, 2023

(54) DOOR ACTUATOR FOR OPENING AND/OR CLOSING A DOOR

(71) Applicant: dormakaba Deutschland GmbH, Ennepetal (DE)

(72) Inventors: Alexander Hellwig, Ennepetal (DE); Thomas Salutzki, Ennepetal (DE); Sabine Weimann, Ennepetal (DE)

(73) Assignee: DORMAKABA DEUTSCHLAND GMBH, Ennepetal (DE)

( * ) Notice: Subject to any disclaimer, the term of this patent is extended or adjusted under 35 U.S.C. 154(b) by 17 days.

(21) Appl. No.: 17/323,525

(22) Filed: May 18, 2021

(65) Prior Publication Data

US 2021/0372190 A1 Dec. 2, 2021

(30) Foreign Application Priority Data

May 26, 2020 (EP) ..... 20176648

(51) Int. Cl.
*E05F 15/49* (2015.01)
*E05F 1/00* (2006.01)
*E05F 15/50* (2015.01)

(52) U.S. Cl.
CPC ..... *E05F 15/49* (2015.01); *E05F 1/006* (2013.01); *E05F 15/50* (2015.01); *E05Y 2201/11* (2013.01); *E05Y 2800/252* (2013.01); *E05Y 2900/132* (2013.01)

(58) Field of Classification Search
CPC . E05F 15/49; E05F 15/50; E05F 1/006; E05F 3/12; E05F 3/04; E05Y 2800/252; E05Y 2201/11; F16K 17/38; F16K 17/383
See application file for complete search history.

(56) References Cited

U.S. PATENT DOCUMENTS 3,094,200 A * 6/1963 Schlage ..... E05F 3/221 16/48.5
3,696,462 A * 10/1972 Martin ..... E05F 3/223 16/49
5,944,399 A * 8/1999 Gillispie ..... E05F 5/12 49/367
6,205,619 B1 * 3/2001 Jang ..... E05D 5/10 16/50
6,425,211 B1 * 7/2002 Wise ..... E05F 1/006 428/209

(Continued)

FOREIGN PATENT DOCUMENTS

DE 4101640 A1 7/1992
DE 202005002474 U1 6/2006

OTHER PUBLICATIONS

English translation of DE202005002474.*

*Primary Examiner* — Justin B Rephann
(74) *Attorney, Agent, or Firm* — Cantor Colburn LLP

(57) ABSTRACT

A door actuator for opening and/or closing a door, includes a fluid housing with an inner compartment, which is filled with fluid, in particular hydraulic oil, a fluid housing opening in the fluid housing for draining the fluid at thermal overload, a thermally activatable valve for opening, which closes the fluid housing opening, and a collecting device, which is disposed outside the fluid housing opposite the fluid housing opening, forms a collecting space for the fluid, is open towards the fluid housing opening, and includes at least one drain opening for draining the fluid from the collecting space.

15 Claims, 6 Drawing Sheets

(56) References Cited

U.S. PATENT DOCUMENTS

| | | | | |
|---|---|---|---|---|
| 6,729,701 | B2 * | 5/2004 | Carter | E05F 5/12 312/409 |
| 8,484,897 | B2 * | 7/2013 | Hsieh | E06B 9/74 160/8 |
| 2019/0085606 | A1 * | 3/2019 | Teta | E05F 1/1207 |

* cited by examiner

DOOR ACTUATOR FOR OPENING AND/OR CLOSING A DOOR

CROSS-REFERENCE TO RELATED APPLICATIONS

This application claims priority to European Patent Application No. 20176648.2, filed on May 26, 2020, the contents of which are hereby incorporated by reference in their entirety.

TECHNICAL FIELD

The disclosure relates to a door actuator for opening and/or closing a door. The door actuator is a door closer or a door drive, for example.

BACKGROUND

Different door actuators are known in the state-of-the-art, which are formed as door closers, for example. An energy accumulator, for example a spring, is pretensioned in the door closer by manually opening the door. The energy accumulator relaxes for closing the door. However, also door drives, which for example electromechanically or hydraulically open and/or close a door are identified as "door actuators". In many door actuators fluids are used, in particular hydraulic oil, in order to transfer forces, be it for executing the opening or closing movement or for dampening a movement. In the event of a fire, these fluids can be a safety risk, because they can be flammable, at least at very high temperatures.

SUMMARY

The present disclosure indicates a door actuator, which allows for a comfortable and low-maintenance operation of a door, while being as safe as possible in the event of a fire.

The advantages are achieved with the features of the independent claim. Advantageous further configurations of the disclosure are the subject matter of the dependent claims.

A temperature safety concept is realized in the inventive door actuator. In the event a building is on fire, said concept ensures that the door actuator mounted on the side of the door facing away from the fire does not contribute to accelerating the fire, at corresponding intense heating because of leaking fluid. At correspondingly high temperature, in particular approx. 115° C., the fluid of the door actuator should escape from the inside of the fluid housing of the door actuator in a defined manner, in order to forestall other components, which could fail at such temperatures. The defined outflow and clever guiding can guide the fluid away from the hot mounting surface, namely in particular from the door leaf, in order to drip to the ground as far as possible away from the hot mounting surface.

The door actuator is formed for opening and/or closing a door. In this case in particular, it can be question of a door closer or a door drive. The door actuator includes a fluid housing with an inner compartment. At least partially, the inner compartment is filled with fluid. In particular, the fluid is hydraulic oil. Forces inside the fluid housing are transmitted with the fluid, in particular in order to perform the opening and/or closing movement of the door and/or to dampen a movement of the door.

In particular, the "fluid housing" is a metal housing, preferably manufactured in a casting process.

Several chambers can be provided in the fluid housing for the fluid and also several pistons moved by the fluid. Furthermore, fluid channels can be formed in the fluid housing, which connect different chambers to each other. Appropriate valves can be located in the fluid channels.

Preferably, at both front faces, the fluid housing is closed with screwed-in cover screws.

Particularly preferred, the door actuator includes an output shaft. In the fluid housing said output shaft is rotatably supported about an output axis.

A connection, for example a square, is located on at least one side of the output shaft for connecting an arm assembly. Said arm assembly allows for transmitting force between door actuator and door leaf, respectively when the door actuator is attached to the door leaf, between door actuator and casing.

Particularly preferred, it is provided that the output shaft projects from the fluid housing on two opposite sides and also has respectively one connection on both sides. Depending on the mounting orientation, for example one of the two connections can be used and is correspondingly connected to the arm assembly. The other connection remains unused. Herein, for the present disclosure, it is possible that based on the two opposite connections at the output shaft, the door actuator does not have a defined top and bottom side, but can be optionally mounted with the one or the other side oriented to the top.

Furthermore preferably, it is provided the door actuator includes a linearly mobile closing piston and a linearly mobile dampening piston in the fluid housing. The output shaft is located between the two pistons. The two pistons move in the fluid housing vertically to the output axis. For transferring force between the linear movement of the piston and the rotary movement of the output shaft, preferably a cam is disposed on the output shaft, wherein corresponding rollers of the pistons roll on the cam. As an alternative, e.g. a toothed wheel can be used at the output shaft, wherein the toothed wheel engages in a toothed rack connected to the closing piston.

With one side, the dampening piston is oriented to the output shaft. The fluid space, which in turn is closed with a cover screw at the front face of the fluid housing, is located on the opposite side. With one side, the closing piston is likewise facing the output shaft. Preferably, a closing spring engages on the other side of the closing piston. The closing spring props up on the closing piston and the other front face of the fluid housing. Preferably, said other front face of the fluid housing is likewise closed with a cover screw.

A fluid housing opening is provided in the fluid housing. In particular, said fluid housing opening is located at the front face at the fluid housing. In particular in a usual installation position of the door actuator, the fluid housing opening extends horizontally such that the fluid horizontally squirts out when draining via the fluid housing opening. In particular preferably, the fluid housing opening is located in the cover screw, which is located on the side of the dampening piston of the door actuator.

The fluid housing opening is formed for draining the fluid, namely in particular the hydraulic oil, at thermal overload. For this purpose, a valve is located in the fluid housing opening, which in normal operation closes the fluid housing opening. For opening, the valve is thermally activatable. As will be described in detail, in particular a trigger element is located in the valve, which at corresponding thermal load is destructed, deforms or melts. Thereby, it is possible for the valve to open at the defined temperature. It should be noted that it is question herein in particular of a valve that cannot be closed again without exchanging parts.

At corresponding thermal load, the thermally activatable valve opens and the fluid squirts out laterally from the fluid housing of the door actuator. Usually, a cover surrounds the fluid housing of the door actuator. For example, an end cap is located at said cover laterally at the fluid housing. Without further precautions, the fluid would squirt against the end cap of the cover and would drain, respectively drip downward in a completely uncontrolled manner. In this case, at least part of the fluid could drain on the mounting side of the door actuator. Said mounting side is the side of the door actuator, which rests at the mounting plate, or when no mounting plate is used, directly at the door leaf or at the door casing. However, if the fluid would drain on the mounting side, the fluid could heat at the hot door and could ignite. With the intention to prevent this from happening, a collecting device is disposed outside the fluid housing, opposite the fluid housing opening.

Said collecting device forms a collecting space for the fluid, is open towards the fluid housing opening, and at least one drain opening is provided. The collected fluid can drain in a targeted manner and at a defined location from the collecting space via said drain opening. Thus, the fluid drips or flows from said drain opening and thereby can be guided in a targeted manner just not in the direction of the mounting side, but in particular in the direction of the opposite side. Thereby, it can be achieved that the fluid does not run down the door leaf, but directly drips on the floor, which in the event of a fire is considerably cooler than the door leaf. Always in this case, it should be noted that it is assumed the door actuator is located on the side of the door facing away from the fire.

The door actuator with the mounting side thereof can be directly attached to the door leaf or the casing. Preferably however, the door actuator comprises a mounting plate. In this case, the mounting plate is attached to the door leaf or the casing. In turn the door actuator is attached to the mounting plate. Preferably, the collecting device is a self-contained assembly, which can be mounted to the fluid housing and/or to the mounting plate and is indestructibly dismountable again. Also in this case, a variant can be selected, in which some components of the collecting device are attachable to the mounting plate and other components of the collecting device to the fluid housing.

Preferably, the entire collecting device is mountable and dismountable again. As an alternative, it is also preferably provided at least one component of the collecting device is firmly connected to or integrally formed with the fluid housing or the mounting plate.

Preferably, it is provided the collecting device comprises a splash wall. The splash wall is located opposite the fluid housing opening and is disposed for collecting the drained fluid in the collecting device. In particular, the splash wall forms one side of the collecting space.

Preferably, at the lower end of the splash wall, the collecting device comprises an inclined drain surface. The fluid impacting on the splash wall runs downward along the splash wall and impacts on the inclined drain surface. With the inclination thereof, the inclined drain surface guides the fluid in the direction of the associated fluid housing opening.

As already explained, preferably, it is provided, depending on the mounting orientation of the door actuator, that two different sides of the door actuator can form the top side. Preferably, accordingly it is provided the collecting device comprises two opposite inclined drain surfaces for the fluid. Depending on the mounting orientation of the door actuator, one of the two drain surfaces is located at the lower end and the other drain surface is unused at the upper end of the splash wall.

With the intention to guide the fluid in an as targeted manner as possible as far as to the fluid housing opening, preferably, it is provided the collecting device comprises at least one inclined additional drain surface for the fluid. The additional drain surface is disposed such that the fluid flows off of the splash wall via the inclined drain surface onto the additional drain surface. The fluid flows on the additional drain surface towards the drain opening.

Particularly preferred, it is provided the collecting device comprises two opposite inclined additional drain surfaces, wherein, depending on the mounting orientation of the door actuator, one of the two additional drain surfaces is located lower than the drain surface located below and the other additional drain surface is located above and unused.

Preferably, the at least one drain opening is located on a side of the collecting device facing away from the mounting side of the door actuator. In particular, it is provided the at least one drain opening merges directly in the surroundings, respectively directly opens to the surroundings so that the fluid exiting from the drain opening drips unguided downwards. Thereby, resulting in a pleasing visual appearance, because the door actuator just has the relatively small drain opening, which is more or less invisible. Preferably, outside said drain opening there are no other components for guiding the fluid.

Furthermore preferably, it is provided the collecting device comprises at least two opposite drain openings for the fluid, wherein, depending on the mounting orientation of the door actuator, one of the drain openings is located at the lower border and the other drain opening is located unused at the upper border of the collecting device.

Furthermore preferably, it is provided the collecting device comprises a plate component. Said plate component forms the splash wall. Preferably, the plate component is disposed at the fluid housing or at a mounting plate of the door actuator. The plate component can be attached, for example screwed, to the fluid housing, respectively the mounting plate. However, it is also possible the plate component is an integral component of the fluid housing or of the mounting plate.

Furthermore preferably, it is provided the collecting device comprises a collecting housing component. The collecting housing component includes at least one drain opening. When using several drain openings, preferably all drain openings are formed at the collecting housing component. Preferably, the collecting housing component is mountable to the plate component. Particularly preferred, it is provided the collecting housing component is fittable on the plate component and/or the cover screw.

Furthermore, it can be provided the collecting housing component is formed in one piece with the plate component, wherein preferably, the collecting housing component is mountable to, in particular fittable on the cover screw.

Preferably, the door actuator comprises a cover, which covers the fluid housing of the door actuator. In particular, a front-sided end cap of said cover forms at least one area of the collecting device. Particularly preferred, the end cap of the cover forms the collecting housing component of the collecting device.

Preferably, the cover comprises a main cover, which covers the fluid housing along the entire length. Said main cover can have a U-shaped cross-section, for example. The two front-sided end caps are disposed on both sides of the main cover. Preferably, the end cap is made from plastic material, wherein a material is used, which withstands the herein occurring temperatures of the fluid. Particularly preferred, the collecting housing component, in particular formed as an end cap, includes an inner wall and an opposite outer wall. Outer wall and inner wall are in particular parallel to with each other and are connected at least on three sides by sidewalls of the collecting housing component. The outer wall and the three sidewalls form the visible area of the end cap. Preferably, to the mounting side, the collecting housing component is open so as to be fittable onto the plate component and/or the cover screw. In this case, then the plate component extends in the area between inner wall and outer wall of the collecting housing component. Preferably, the inner wall of the collecting housing component is open, so that the fluid can squirt in through the inner wall.

Preferably, the plate component forms the splash wall. However, as an alternative, the inside of the outer wall of the collecting housing component can form the splash wall.

Preferably, the above-mentioned inclined drain surface, respectively the two opposite inclined drain surfaces are a part of the plate component. Preferably, the at least one optional additional drain surface is formed in the collecting housing component.

Preferably, the valve closing the fluid housing opening comprises a valve body and a valve cover screw. The valve body is seated in a corresponding valve seat in the fluid housing opening. At correspondingly high fluid pressure, the fluid presses the valve body outwards so as to detach from the valve seat thereof. The valve cover screw is screwed into the fluid housing opening. The trigger element is located between the valve cover screw and the valve body. Preferably, the trigger element is clamped between the valve cover screw and the valve body so that the trigger element keeps the valve body in the valve seat thereof.

For opening the valve by thermal effect, the trigger element is destructible and/or deformable and/or meltable. For example, the trigger element is a thermo glass vial, such as known in sprinkler systems, for example. The thermo glass vial is filled with a medium, which makes the vial break at correspondingly high temperature. Thereby destroying the trigger element formed as the thermo glass vial, whereby again the support of the valve body ceases to exist with regard to the valve cover screw. At correspondingly high pressure of the fluid, the valve body releases the fluid housing opening.

Furthermore, it is provided the trigger element is made for example from plastic material, which melts at the desired temperature or as a further alternative for the trigger element, for example a component made from solder alloy is provided.

Preferably, the valve cover screw is fluid permeable. In particular, the valve cover screw includes at least one hole, so that upon opening the valve, the valve cover screw stays put, however, the fluid can flow through the valve cover screw. As an alternative, a channel can be provided as well, which guides the fluid past the valve cover screw.

BRIEF DESCRIPTION OF THE DRAWINGS

Now, the disclosure is described in more detail based on an exemplary embodiment. In this case, it shows.

DETAILED DESCRIPTION OF THE DRAWINGS

Figure 1:
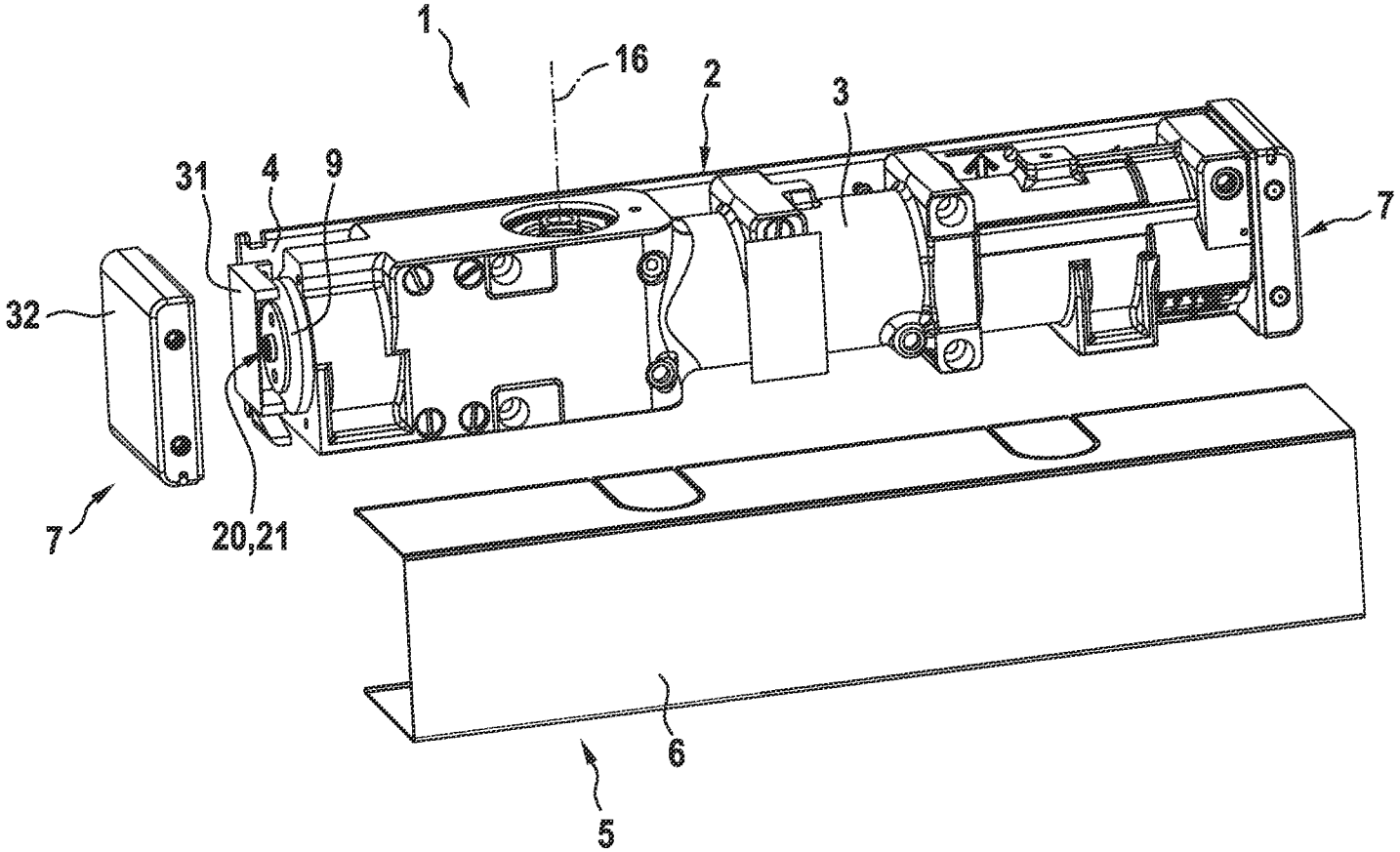
FIG. 1 an inventive door actuator according to an exemplary embodiment.

In the following a door actuator 1, formed as a door closer, is explained in detail. In this case, unless otherwise stated, reference is always made to all the Figures.

The door actuator 1 includes a fluid housing 3. Herein, the fluid housing 3 is a cast component from metal. Via a mounting plate 4 of the door actuator 1, the fluid housing 3 can be attached to a door leaf or a casing of a door. The attachment side is also referred to as the mounting side 2.

Furthermore, the door actuator 1 comprises a cover 5. The cover 5 comprises a main cover 6, which covers the fluid housing 3 on three sides. Front-sided, the cover 5 comprises two end caps 7 for covering the two front faces of the fluid housing 3.

Figure 2:
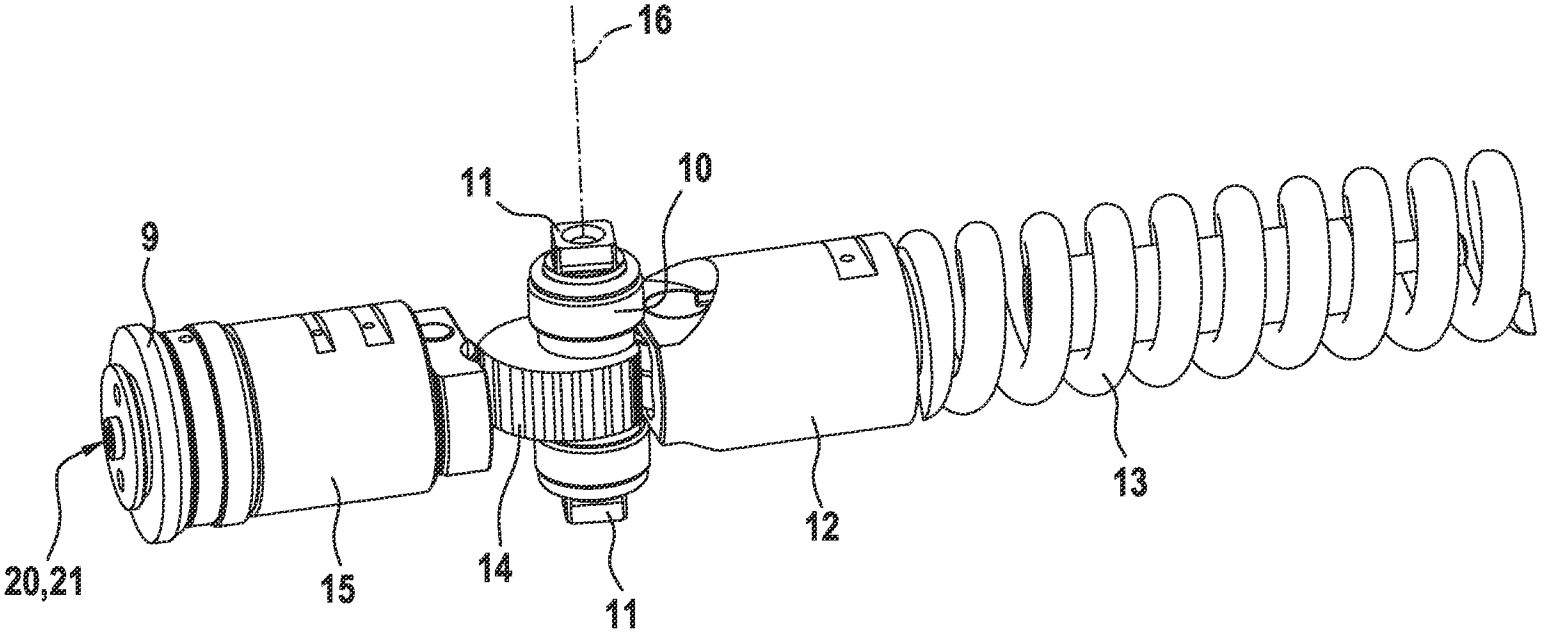
FIG. 2 essential components inside the inventive door actuator according to the exemplary embodiment, FIG. 3 a sectional view in the area of a cover screw of the inventive door actuator according to the first exemplary embodiment, FIG. 4 a collecting device of the inventive door actuator according to the exemplary embodiment, FIG. 5 a first sectional view of the collecting device of FIG. 4, and FIG. 6 a second sectional view of the collecting device of FIG. 4.

As in particular revealed in the combined view of the FIGS. 1 and 2, the door actuator 1 comprises an output shaft 10, which is rotatably mobile supported in the fluid housing 3. In this case, the rotary movement is about an output axis 16. When usually using the door actuator 1, said output axis 16 is vertical.

In the example shown, the output shaft 10 has a connection on both sides, formed as a square. The door actuator 1 can be mounted in two mounting orientations such that optionally the one or the other connection 11 is oriented upwards.

The fluid housing 3 forms an inner compartment 8 (see FIG. 3), which can be subdivided into individual fluid compartments. At the two front faces, the fluid housing 3 comprises respectively one cover screw 9, which seals the inner compartment 8. Fluid, in particular hydraulic oil, is in the inner compartment 8.

As revealed in FIG. 2, a closing piston 12 and a closing spring 13 are located in the inner compartment 8. With an appropriate roller, the closing piston 12 bears on a cam 14 of the output shaft 10. The closing spring 13 acts on the opposite side of the closing piston 12. By manually opening the door, the output shaft 10 is entrained into rotation. Thereby, the cam 14 and the closing piston 12 are moved to the right (according to the illustration in FIG. 2). Thereby, the closing spring 13 is tensioned. When closing the door, the closing spring 13 relaxes, the closing piston 12 is moved to the left, whereby the output shaft 10 is again entrained into rotation. With the intention to dampen said closing movement, the dampening piston 15 is disposed in the inner compartment 8, which is in contact with the cam 14 likewise via an appropriate roller. The cover screw 9 shown in the FIGS. 2 and 3 closes the front face facing the dampening piston 15. A fluid housing opening 20 is formed in said cover screw 9. A valve 21, which is thermally activatable, is located in said fluid housing opening 20.

Figure 3:
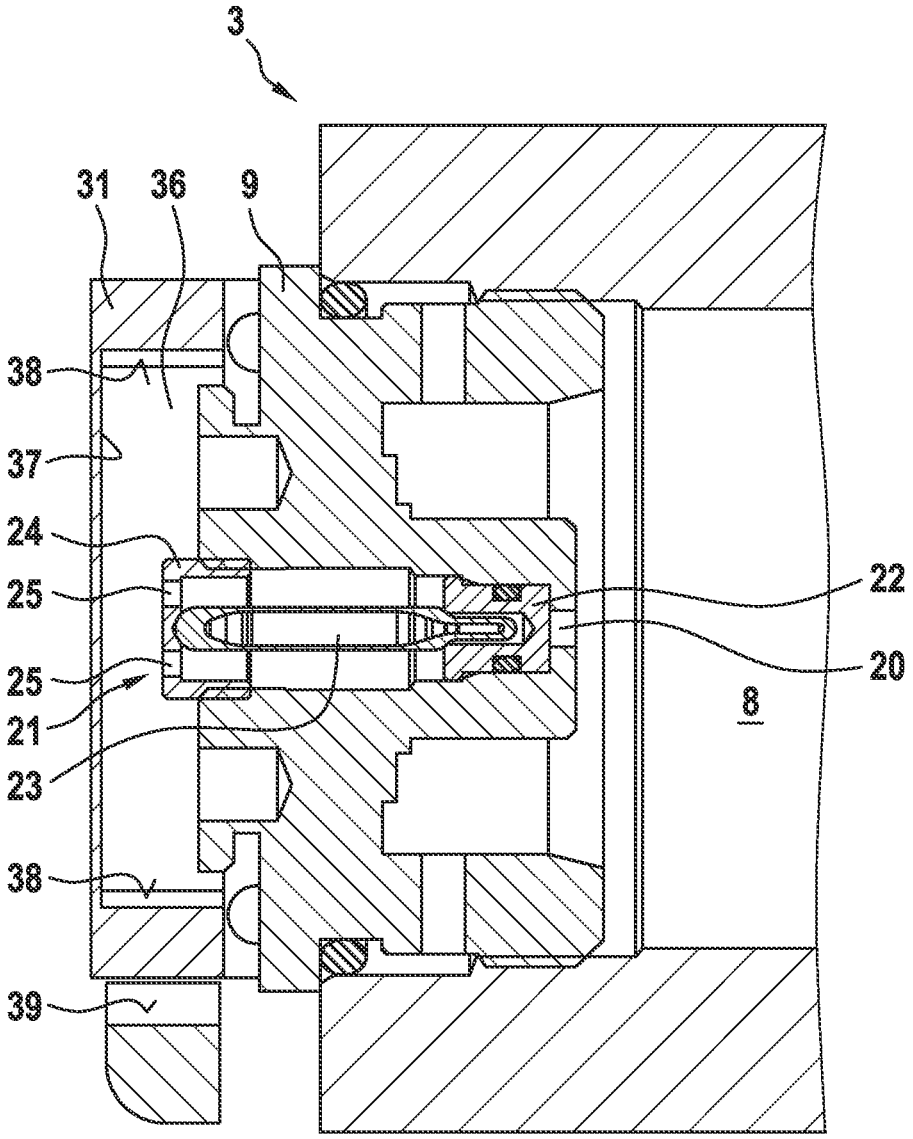

FIG. 3 shows in detail that the valve 21 includes a valve body 22, which is sealingly seated in the fluid housing opening 20. On the outside, a valve cover screw 24 is screwed into the fluid housing opening 20. A trigger element 23, which, in the intact condition thereof retains the valve body 22 in the valve seat, is located between the valve body 22 and the valve cover screw 24.

In the exemplary embodiment shown, the trigger element 23 is formed as a thermo glass vial. Under corresponding thermal effect said thermo glass vial is destroyed. Thereby, allowing the valve body 22 to detach from the valve seat thereof on account of a correspondingly high internal pressure in the inner compartment 8.

The valve cover screw 24 includes several holes 25, through which the fluid can squirt to the outside.

A collecting device 30 is located outside the fluid housing 3, at the front face with the fluid housing opening 20. In this exemplary embodiment, a plate component 31 and a collecting housing component 32 form the collecting device 30. Simultaneously, the collecting housing component 32 is one of the two end caps 7 of the cover 5.

Figure 4:
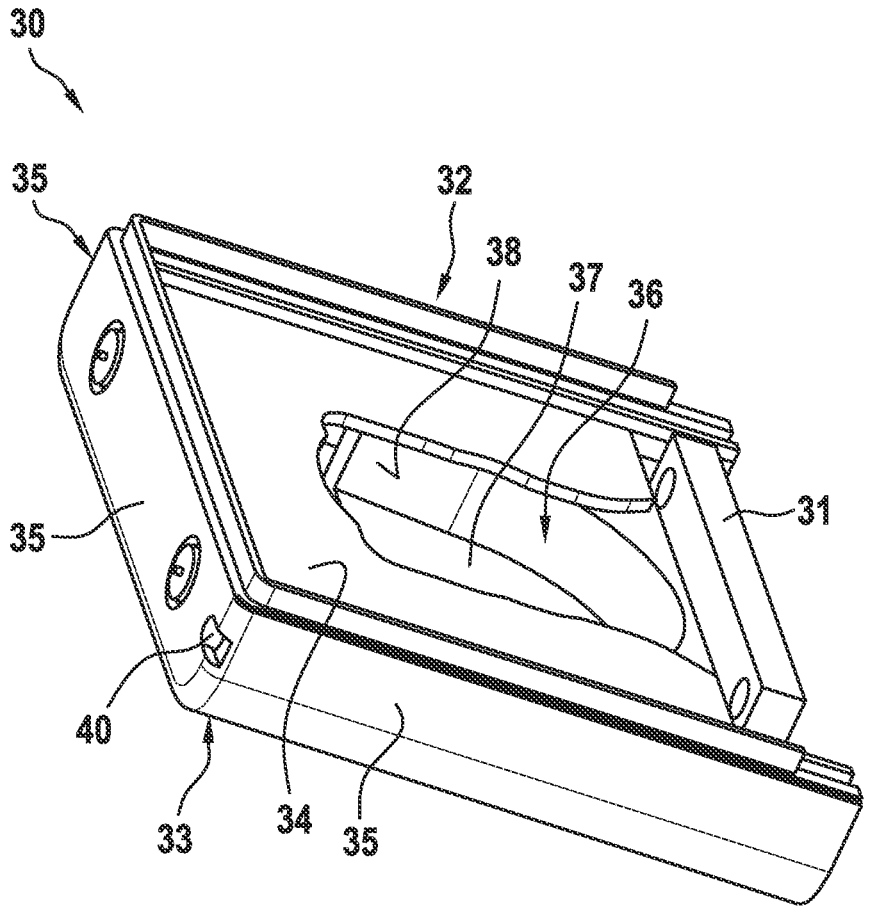
Figure 5:
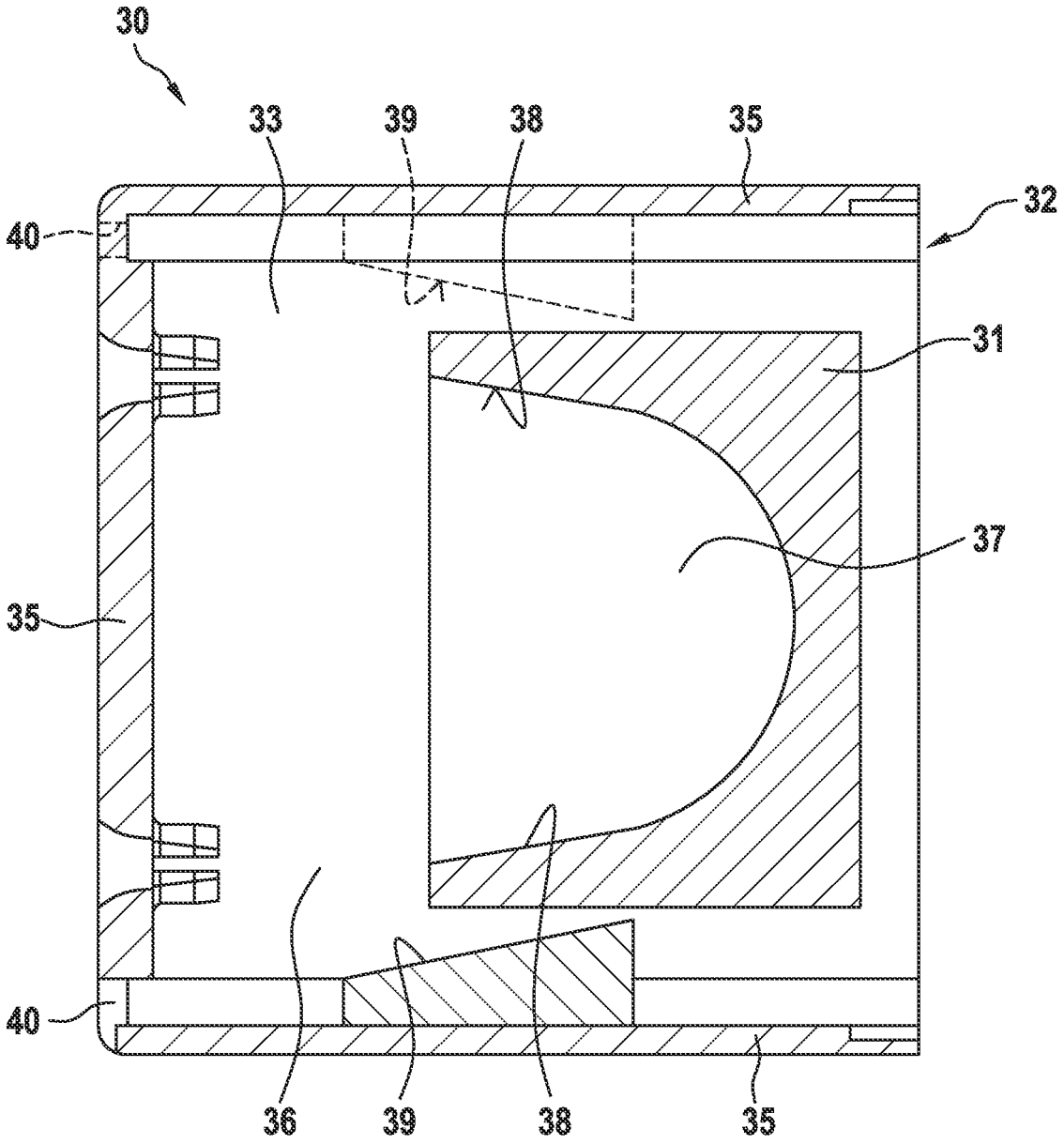
Figure 6:
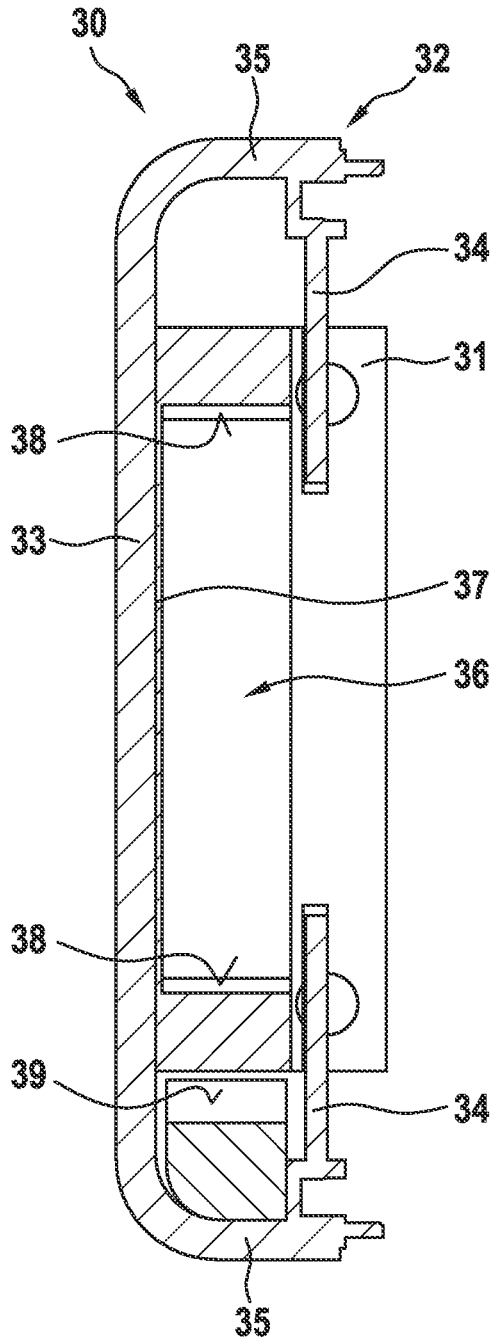

In FIG. 3, the collecting housing component 32 is almost completely masked. Just a wedge-shaped insert, which forms an additional drain surface 39, is illustrated herein. FIG. 4 shows the complete collecting device 30. FIGS. 5 and 6 show two sectional views through said collecting device 30.

The collecting housing component 32 includes an outer wall and an opposite inner wall 34. Outer wall 33 and inner wall 34 are spaced apart from each other and on three sides connected via sidewalls 35. Components of the end cap 7 visible from outside are the outer wall 33 and the three sidewalls 35. Towards the mounting side 2, the collecting housing component 32 is open, so as to be slidable onto the plate component 31. The inner wall 34 is open so that the fluid can squirt into the collecting device 30.

In the exemplary embodiment shown, the plate component 31 is attachable to the mounting plate 4, in particular screwable.

The collecting device 30 forms a collecting space 36, which collects the fluid leaking from the fluid housing opening 20. A splash wall 37 delimits said collecting space 36. The splash wall 37 is a vertically upright wall, which herein the plate component 31 forms. Respectively one inclined drain surface 38 is provided on both sides, namely at the upper and lower ends of the splash wall 37. The plate component 31 forms the inclined drain surfaces 38. Depending on the mounting orientation of the door actuator, one of both inclined drain surfaces 38 is located on the top side and thus is unused. The fluid runs downwards at the splash wall 37 onto the inclined drain surface 38 disposed underneath the splash wall 37.

In the exemplary embodiment, the additional drain surface 39 is provided, which a correspondingly wedge-shaped part forms and which is disposed in the collecting housing component 32. The fluid flows over the inclined drain surface 38 onto the additional drain surface 39 and from there to a drain opening 40.

Independently of the rest of the configuration of the exemplary embodiment, the drain opening 40 is located on a side of the collecting device 30 facing away from the mounting side 2.

Complementary to the illustration shown, it is preferably provided as well that the collecting device 30, in particular the collecting housing component 32 includes two opposite drain openings 40, wherein the top located drain opening 40 then remains unused. It is likewise possible to provide an additional drain surface 39 on both sides.

The invention claimed is:

1. A door actuator for opening and/or closing a door, the door actuator comprising:

a fluid housing with an inner compartment, which is filled with fluid, a fluid housing opening in the fluid housing for draining the fluid at thermal overload, a thermally activatable valve located in said fluid housing opening and being configured to close the fluid housing opening, and a collecting device, disposed outside the fluid housing opposite the fluid housing opening, forms a collecting space for the fluid, is open towards the fluid housing opening, and includes at least one drain opening located on a side of the collecting device and being configured for draining the fluid from the collecting space.

2. The door actuator according to claim 1, wherein the collecting device comprises a splash wall opposite the fluid housing opening and disposed for collecting the drained fluid in the collecting space.

3. The door actuator according to claim 2, wherein the splash wall has an upper end and a lower end wherein at the lower end, the collecting device comprises a drain surface inclined towards the drain opening for the fluid.

4. The door actuator according to claim 3, wherein the collecting device comprises two drain surfaces for the fluid that are oppositely inclined, wherein, depending on the mounting orientation of the door actuator, one of the two drain surfaces is located at the lower end and the other drain surface is unused at the upper end.

5. The door actuator according to claim 3, wherein the collecting device comprises at least one inclined additional drain surface for the fluid, wherein the additional drain surface is disposed such that the fluid flows from the splash wall over the inclined drain surface onto the additional drain surface and from the additional drain surface to the drain opening.

6. The door actuator according to claim 1, wherein the at least one drain opening is disposed on a side of the collecting device facing away from a mounting side of the door actuator.

7. The door actuator according to claim 1, wherein the at least one drain opening directly opens to surroundings.

8. The door actuator according to claim 1, wherein the collecting device comprises at least two opposite drain openings for the fluid, wherein, depending on the mounting orientation of the door actuator, one of the two drain openings is located at a lower border and the other of the two drain openings is unused and located at an upper border of the collecting device.

9. The door actuator according to claim 1, wherein the collecting device comprises a plate component, wherein the plate component forms the splash wall and is disposed at the fluid housing or at a mounting plate.

10. The door actuator according to claim 1, wherein the collecting device comprises a collecting housing component, wherein the collecting housing component comprises the at least one drain opening, wherein the collecting housing component is mountable to a cover screw.

11. The door actuator according to claim 1, comprising a cover covering the fluid housing of the door actuator, wherein at least one area of the collecting device, is formed by a front-sided end cap of the cover.

12. The door actuator according to claim 1, wherein the collecting housing component is integrally formed with the plate component, wherein the collecting housing component is mountable to a cover screw.

13. The door actuator according to claim 12, wherein the valve comprises a valve body in the fluid housing opening and a valve cover screw screwed into the fluid housing opening, wherein the trigger element is clamped between the valve body and the valve cover screw.

14. The door actuator according to claim 1, wherein the valve comprises a trigger element, which, for opening the valve, is destructible and/or deformable and/or meltable under thermal effect.

15. The door actuator according to claim 14, wherein the valve cover screw is fluid permeable.

* * * * *